US011399668B2

(12) United States Patent
Wu et al.

(10) Patent No.: US 11,399,668 B2
(45) Date of Patent: Aug. 2, 2022

(54) HANDHELD SHOWER

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Ching-Yin Wu, Taichung (TW); Che-Min Lin, Taichung (TW)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 82 days.

(21) Appl. No.: 17/073,956

(22) Filed: Oct. 19, 2020

(65) Prior Publication Data

US 2022/0117446 A1 Apr. 21, 2022

(51) Int. Cl.

| | |
|---|---|
| ***A47K 3/28*** | (2006.01) |
| ***B05B 1/18*** | (2006.01) |
| *A47K 5/12* | (2006.01) |

(52) U.S. Cl.

CPC ..... *A47K 3/288* (2013.01); *B05B 1/185* (2013.01); *A47K 5/1201* (2013.01)

(58) Field of Classification Search

CPC ..... A47K 3/288; B05B 1/18; B05B 1/185

See application file for complete search history.

(56) References Cited

U.S. PATENT DOCUMENTS

| | | | | |
|---|---|---|---|---|
| 3,797,747 | A * | 3/1974 | Buzzi | E03C 1/046 239/311 |
| 2003/0230645 | A1* | 12/2003 | Groblebe | A01K 13/001 239/526 |
| 2020/0216340 | A1* | 7/2020 | Jansen | B01D 27/08 |
| 2020/0315406 | A1* | 10/2020 | Wozny-Karnik | B05B 1/16 |

FOREIGN PATENT DOCUMENTS

| | | | |
|---|---|---|---|
| DE | 199 08 121 | A1 | 9/2000 |
| DE | 10 2004 054 139 | A | 5/2006 |
| DE | 20 2010 012 116 | U1 | 2/2011 |
| KR | 20-0491735 | Y1 | 5/2020 |
| TW | M384711 | U1 | 7/2010 |
| TW | 201605394 | A | 2/2016 |
| WO | WO 2012/149967 | A1 | 11/2012 |

OTHER PUBLICATIONS

Extended European Search Report dated Jan. 19, 2022 for Application No. 21187185.0.

Taiwanese Search Report dated Nov. 2, 2021 for Application No. 110114036 with an English translation.

* cited by examiner

*Primary Examiner* — J C Jacyna

(74) *Attorney, Agent, or Firm* — Birch, Stewart, Kolasch & Birch, LLP

(57) ABSTRACT

A handheld shower includes a shower body and a liquid storage tank. The shower body has an inlet channel and an outlet portion, and the inlet channel communicates with the outlet portion. The liquid storage tank has a receiving space and a liquid outlet, and the receiving space is adapted to receive a cleaning solution. The liquid outlet communicates with the receiving space and is adapted to output the liquid solution inside the receiving space. The liquid storage tank is detachably engaged with the shower body, and the handheld shower is light and easy to carry. Thereby, users no need to carry many bottles of cleaning solution when traveling or on business trips, and have their own handheld shower when they are going out, enhancing the convenience of the journey and the comfort of bathing outside.

17 Claims, 10 Drawing Sheets

HANDHELD SHOWER

BACKGROUND OF THE INVENTION

Technical Field

The present invention relates generally to a shower apparatus, and more particularly to a handheld shower having a liquid storage tank.

Description of Related Art

With the evolution of society and the improvement of people's economic conditions, modern people have stricter requirements for sanitary equipment. To meet modern people's needs for sanitary equipment and maintain the freshness of products, the industry not only needs to pay attention to the practicality of sanitary products, but also need to strive for innovation. Whether it is to improve the appearance of the product or enhance the functionality of the product, it could bring huge business opportunities.

Modern people often need to bring bottles of shampoo and body wash and other liquid solution when traveling or on business trips. Even some travelers who pay much attention to the quality of life would like to bring their shower heads when they are going out, which provides a comfortable feeling like bathing at home. However, carrying many bottles has caused great inconvenience to travelers, and the existing handheld showers are bulky, and it is difficult to carry them around. Therefore, it is necessary to solve the aforementioned problems to improve the convenience of the journey and the comfort of bathing outside.

BRIEF SUMMARY OF THE INVENTION

In view of the above, the primary objective of the present invention is to provide a handheld shower, which is not only light and easy to carry, but also could receive a cleaning solution to reduces shower cleaning products that the user carries.

The present invention provides a handheld shower, including a shower body and a liquid storage tank. The shower body has an inlet channel and an outlet portion, wherein the inlet channel communicates with the outlet portion. The liquid storage tank is detachably engaged with the shower body and having a receiving space and a liquid outlet, wherein the receiving space is adapted to receive a cleaning solution. The liquid outlet communicates with the receiving space and is adapted to output the liquid solution inside the receiving space.

With the aforementioned design, the handheld shower is light and easy to carry, enhancing the shower experience. In addition, the liquid storage tank of the handheld shower could receive a cleaning solution, no need to carry bottles, which helps to reduce the weight of luggage.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

A handheld shower 100 according to a first embodiment of the present invention is illustrated in FIG. 1 to FIG. 9 and includes a shower body 10 and a liquid storage tank 20, wherein the liquid storage tank 20 is detachably engaged with the shower body 10.

Figure 8:
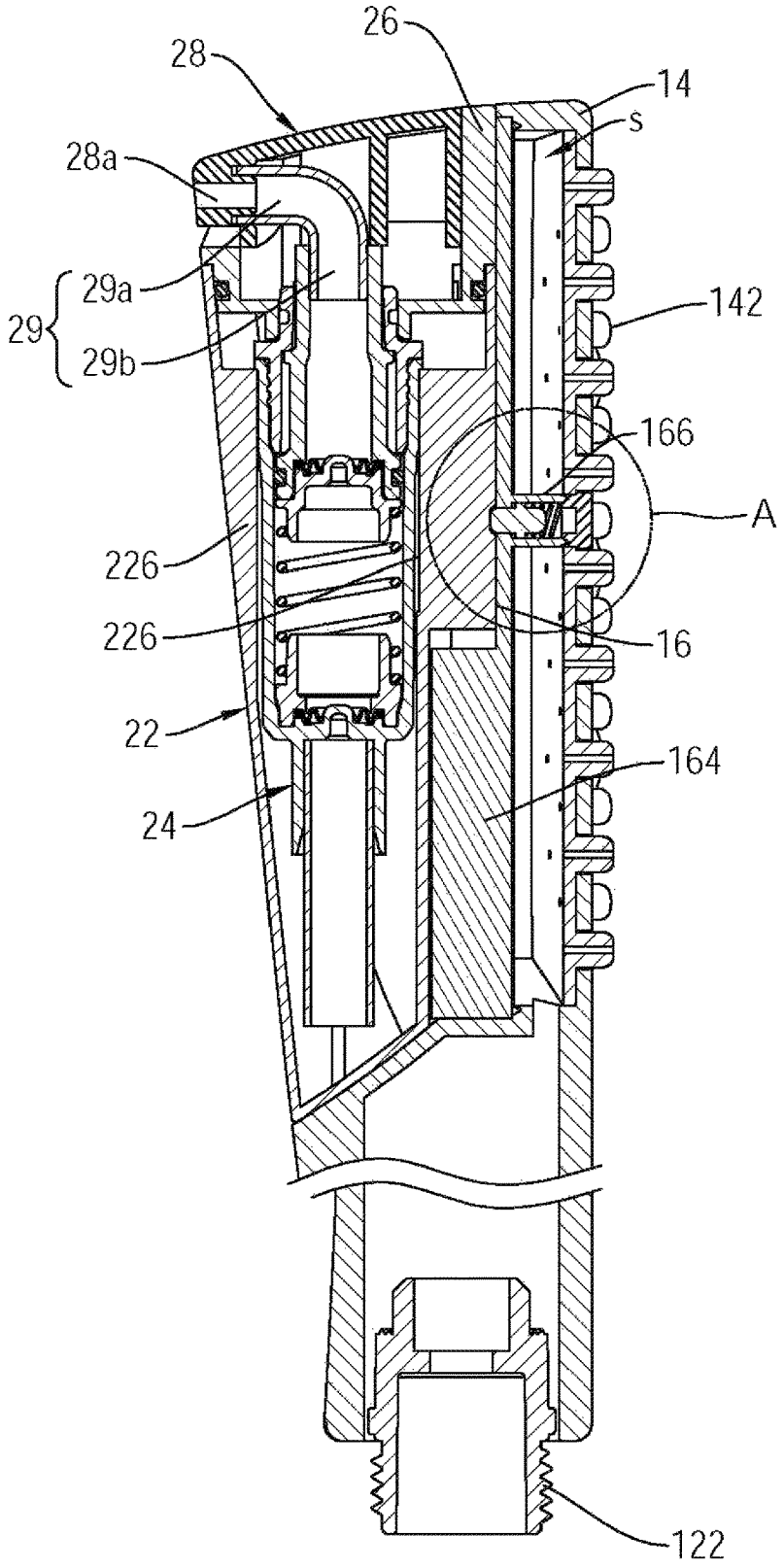
FIG. 8 is a sectional view along the 8-8 line in FIG. 7.

The shower body 10 includes a handheld portion 12, a front panel 14 and a rear panel 16, wherein the handheld portion 12 and the front panel 14 are integrally formed as a monolithic unit. The handheld portion 12 has an inlet portion 122 and is adapted to be connected to an external water source (not shown). The front panel 14 has an outlet portion 142. The rear panel 16 is engaged with a side of the front panel 14 opposite to the outlet portion 142. As shown in FIG. 8, a part of an inlet channel S is formed between the front panel 14 and the rear panel 16, wherein the inlet portion 122 communicates with the outlet portion 142 via the inlet channel S.

Figure 4:
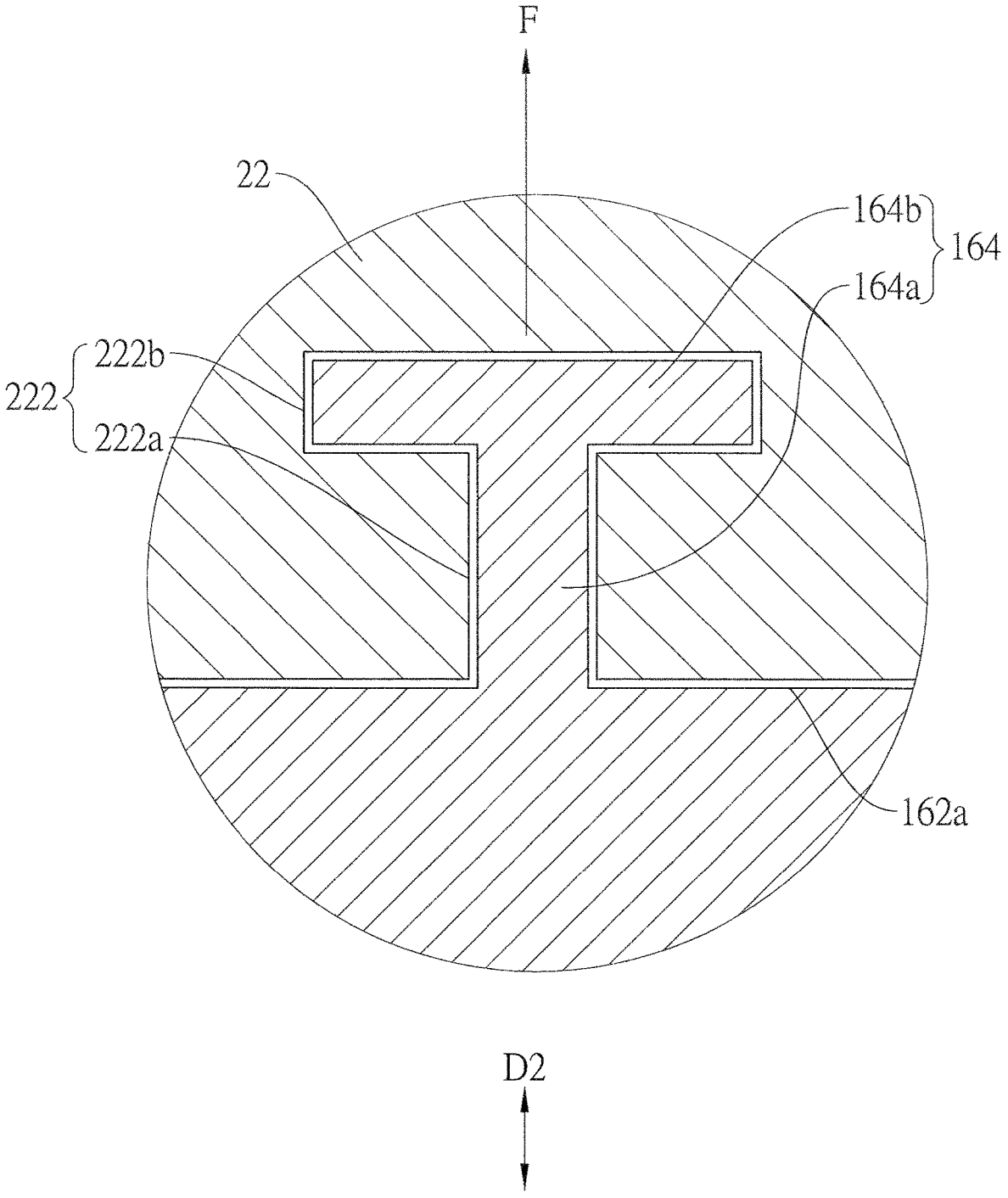
FIG. 4 is a partially schematic view of the handheld shower showing the engaging track the engaging groove.
Figure 5:
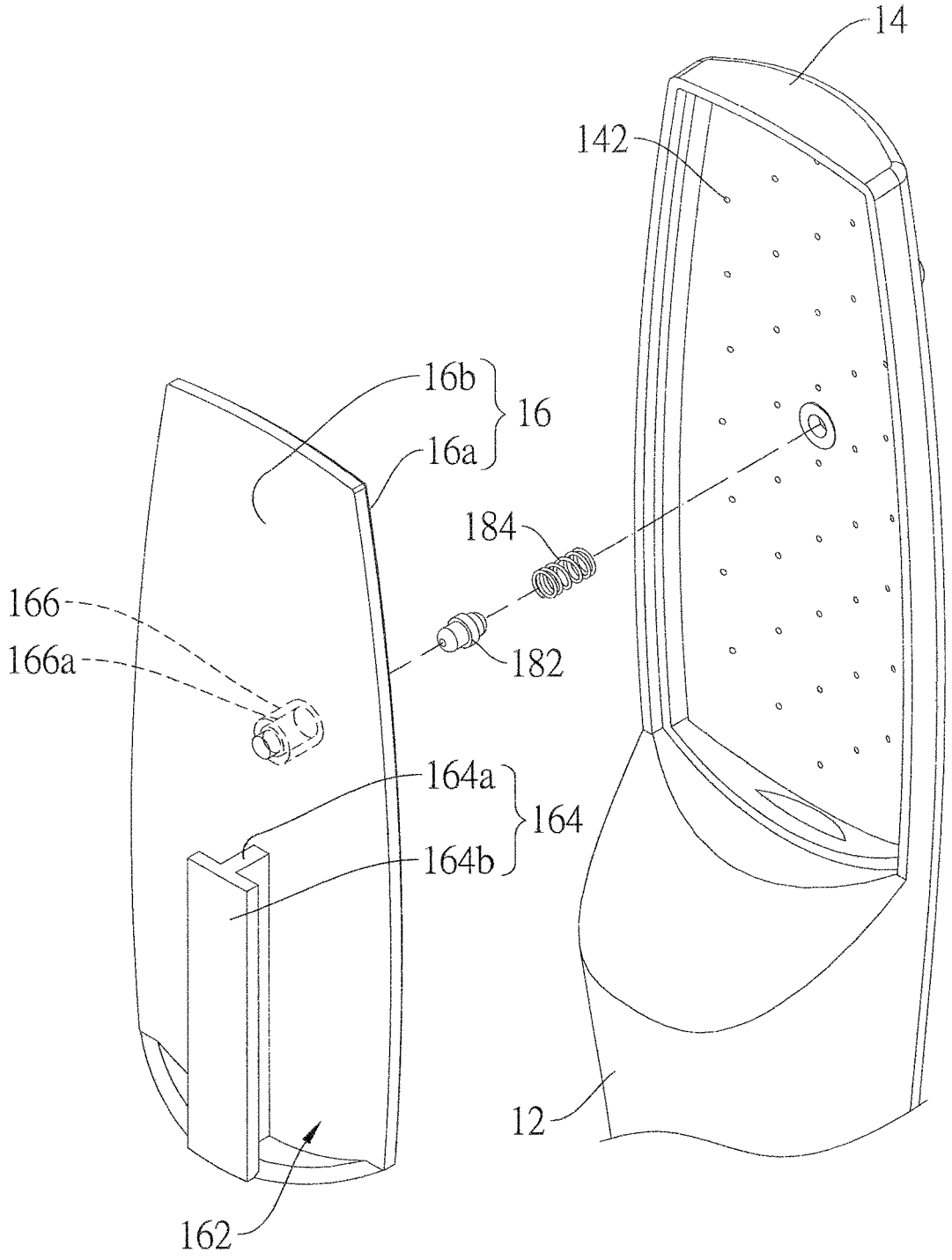
FIG. 5 is an exploded view of the shower body according to the first embodiment of the present invention.
Figure 6:
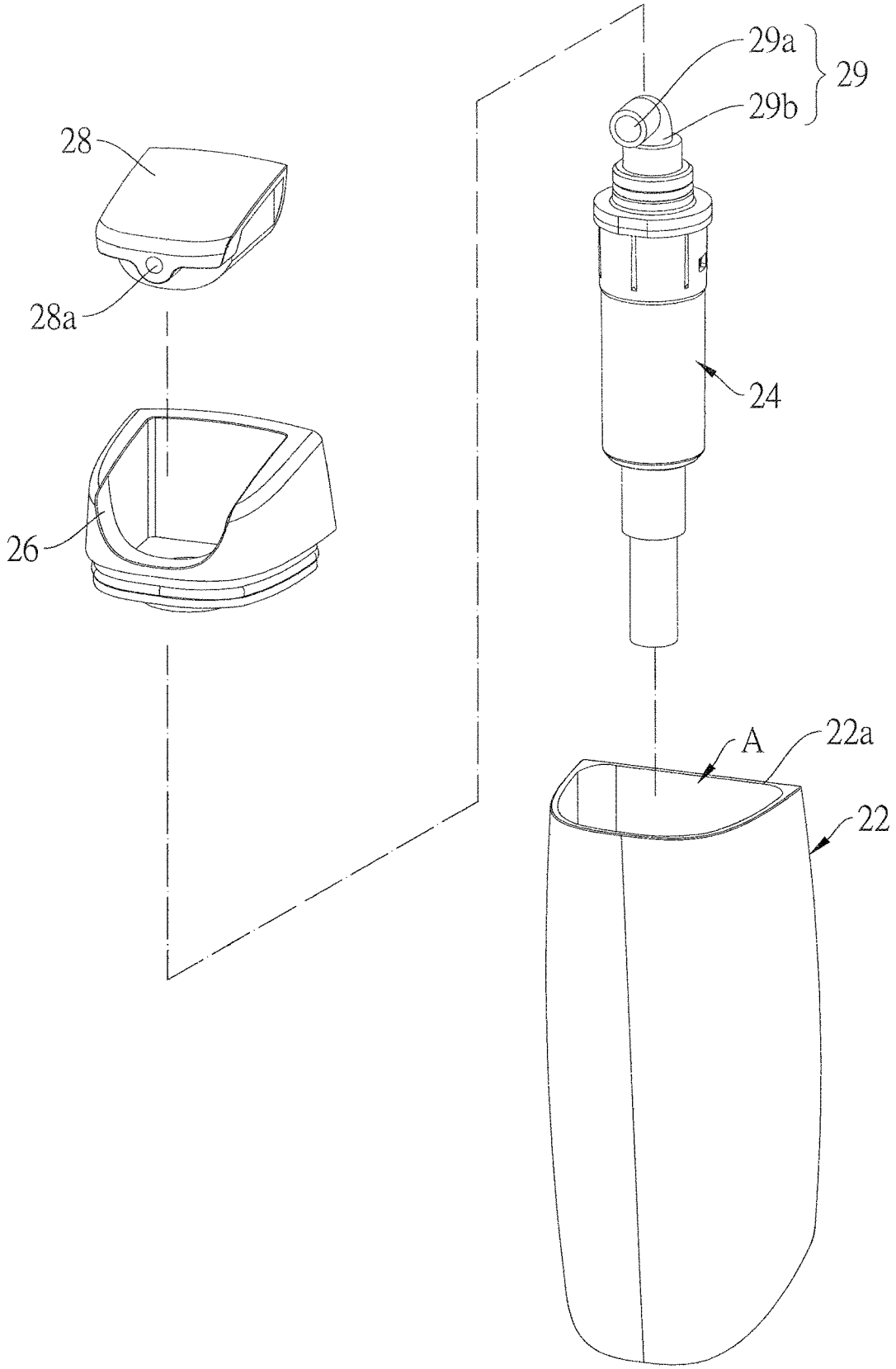
FIG. 6 is an exploded perspective view of the liquid storage tank according to the first embodiment of the present invention.
Figure 7:
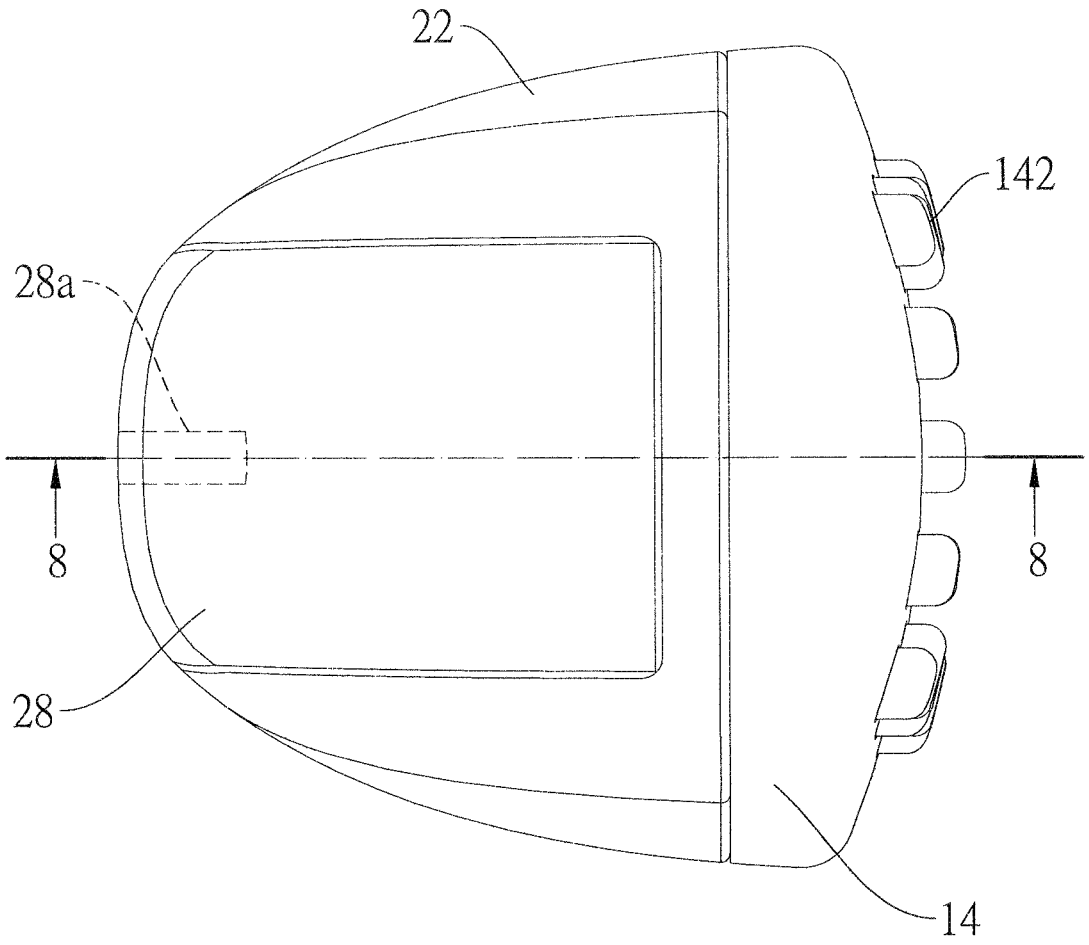
FIG. 7 is a top view of FIG. 2.

The rear panel 16 has a front surface 16*a* and a rear surface 16*b* which face opposite directions, wherein the front surface 16*a* of the rear panel 16 faces the outlet portion 142. The rear panel 16 has a receiving groove 162, an engaging track 164, and a projection 166, wherein the receiving groove 162 disposed on the rear surface 16*b* and is adapted to be engaged with the liquid storage tank 20. The engaging track 164 is a first engaging portion of the current embodiment. The engaging track 164 extends along a first predetermined direction D1 and is formed on a groove surface 162*a* of the receiving groove 162, wherein the first predetermined direction D1 is a longitudinal direction of the shower body 10. As shown in FIG. 4, the engaging track 164 has a narrow section 164*a* and a wide section 164*b* in a direction away from the groove surface 162*a* of the receiving groove 162, wherein the narrow section 164*a* is connected to the groove surface 162*a*. In the current embodiment, a cross-section contour of the engaging track 164 is, but not limited to T-shaped. In other embodiments, the cross-section contour of the engaging track 164 could be other shapes, such as in shape of an arrow or a circle arc, as long as a width of the wide section is greater than a width of the narrow section in a third predetermined direction D3 defined on the cross-section contour.

Figure 9:
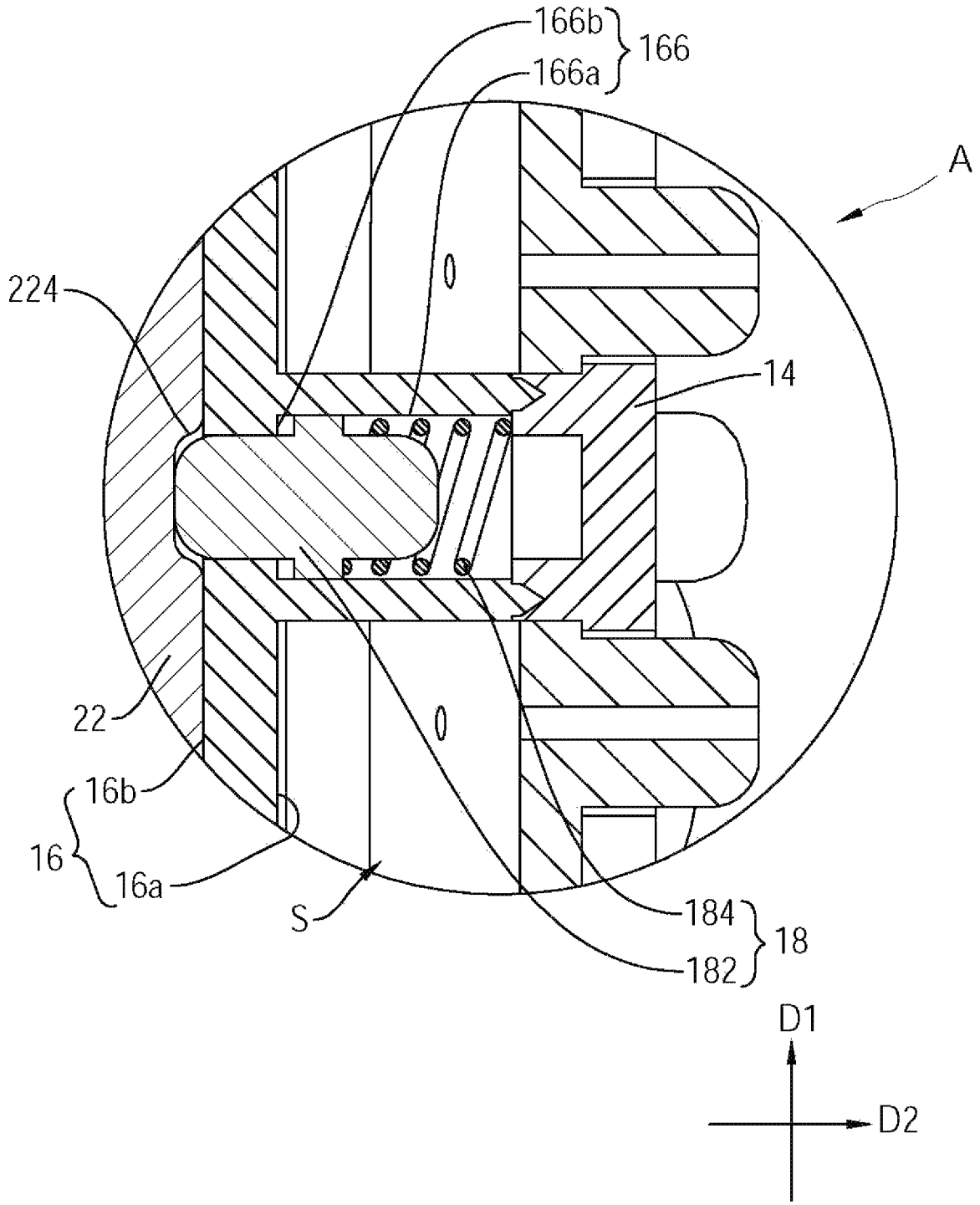
FIG. 9 is a partially enlarged view of a marked region A in FIG. 8.

As shown in FIG. 9, the projection 166 protrudes from the front surface 16*a* of the rear panel 16 along a second predetermined direction D2, wherein the second predetermined direction D2 is orthogonal to both of the first predetermined direction D1 and the third predetermined direction D3. The projection 166 has an engaging hole 166*a* penetrating through the rear surface 16*b* from an end of the projection 166 to the rear surface 16*b* of the rear panel 16, that is, an axial direction of the engaging hole 166*a* is parallel to the second predetermined direction D2, wherein a diameter of the engaging hole 166*a* at the projection 166 is large than a diameter of the engaging hole 166*a* at the rear surface 16*b*, thereby forming a shoulder 166*b* in the engaging hole 166*a*. A positioning member 18 is disposed in the engaged hole 166*a*, wherein the positioning member 18 includes a positioning protrusion 182 and a spring 184. A side of the positioning protrusion 182 is connected to an end of the spring 184, and another side of the positioning protrusion 182 abuts against the shoulder 166*b* and partially protrudes from the rear surface 16*b* of the rear panel 16. Another end of the spring 184 that is not connected to the positioning protrusion 182 is engaged with the front panel 14.

Figure 1:
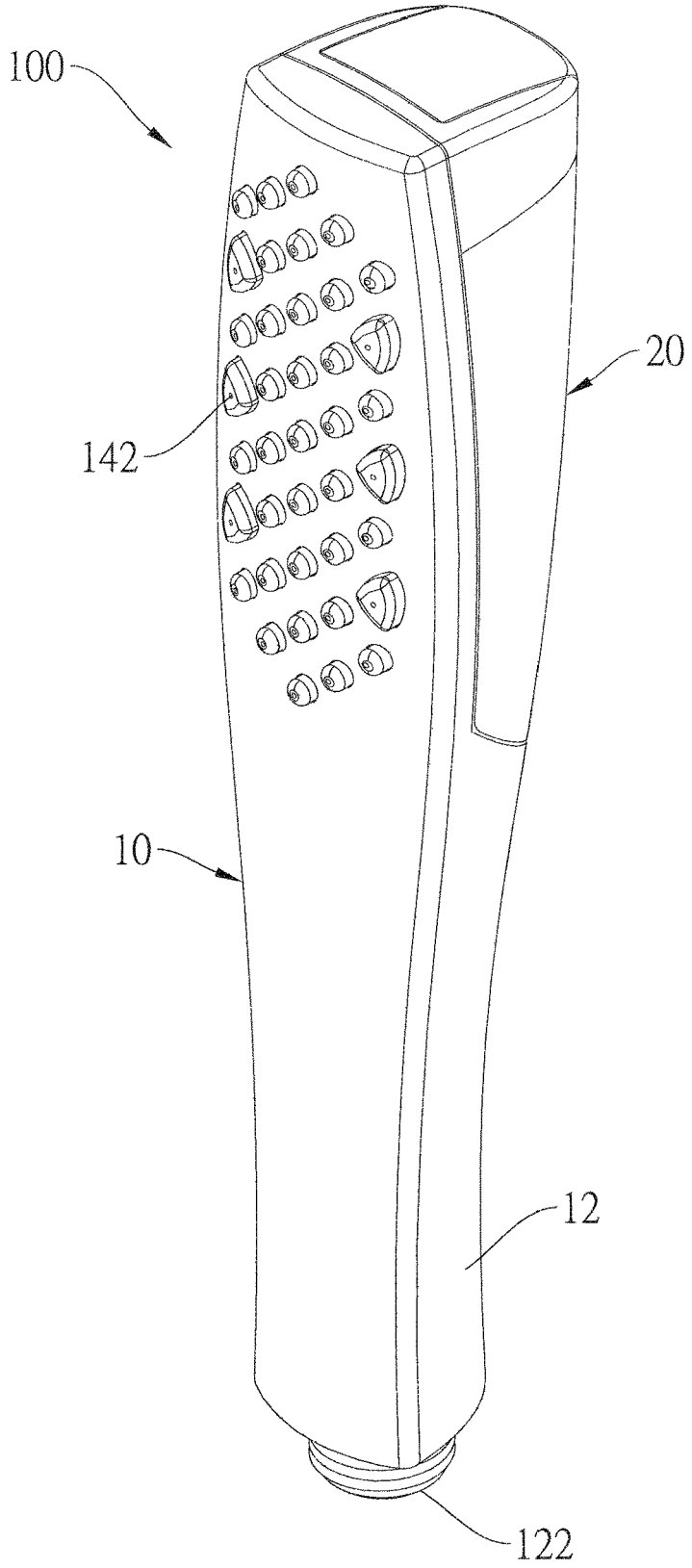
FIG. 1 is a perspective view of the handheld shower according to a first embodiment of the present invention.
Figure 2:
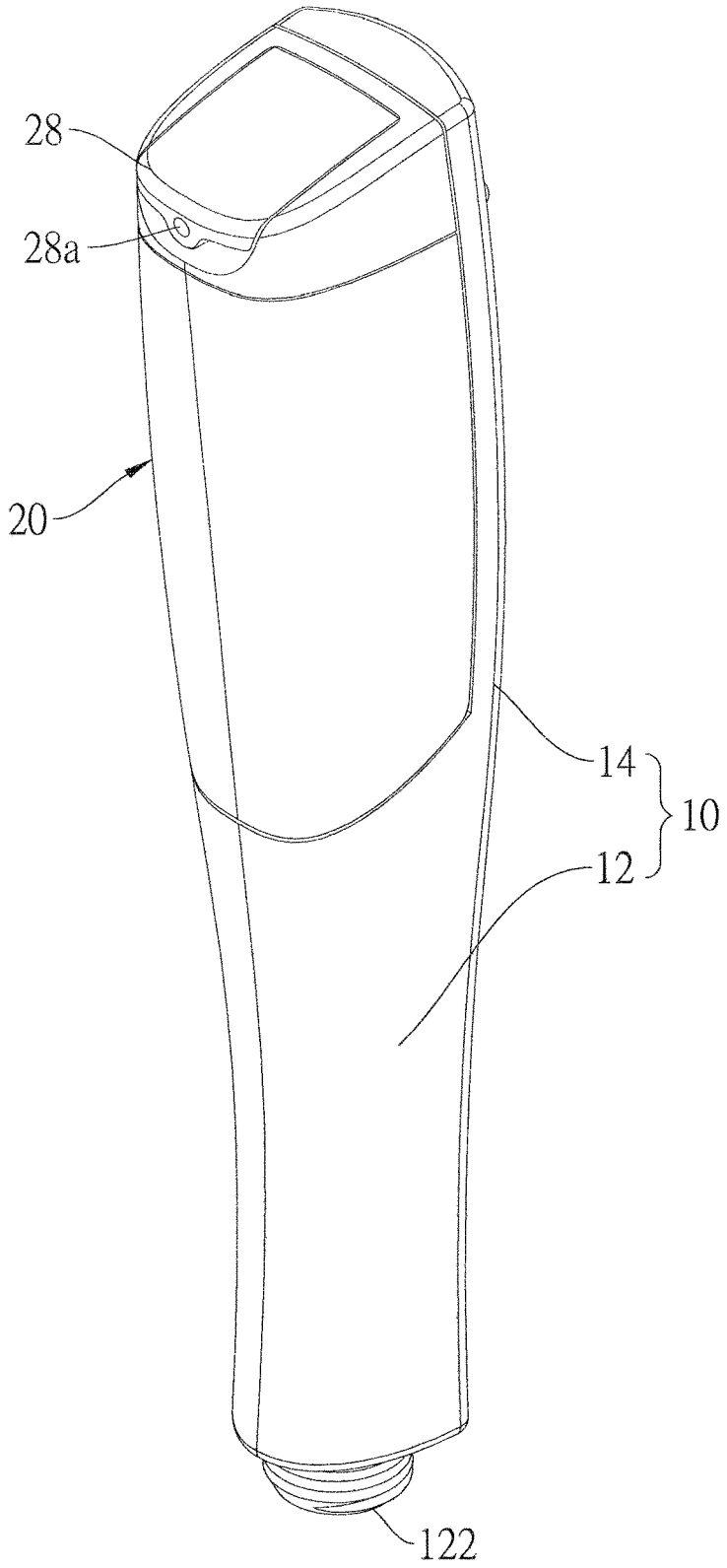
FIG. 2 is a perspective view showing the handheld shower shown in FIG. 1 seen from another direction.
Figure 3:
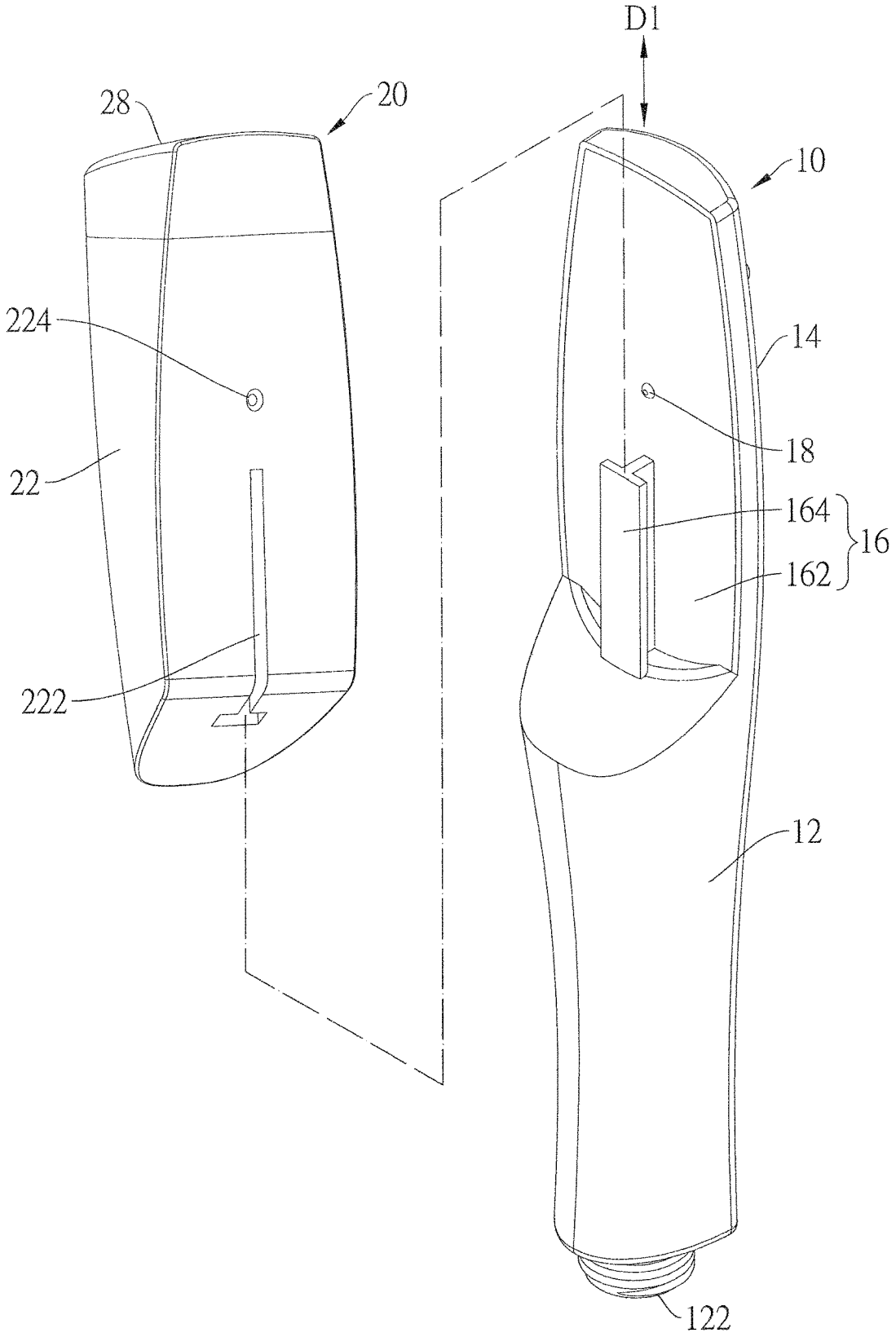
FIG. 3 is a partially exploded view of the handheld shower according to the first embodiment of the present invention.

The liquid storage tank 20 has a box body 22, a pump tube 24, a cap body 26 and a pressing member 28, wherein the box body 22 has a receiving space A therein, and the receiving space A communicates with an outside via an opening 22*a*, so that liquid solutions such as shampoo or shower gel could be received in the receiving space A through the opening 22*a*. As shown in FIG. 3 and FIG. 4, a side surface of the box body 22 facing the shower body 10 has an engaging groove 222 corresponding to the engaging track 164 and a positioning hole 224 corresponding to the positioning member 18. The engaging groove 222 is a second engaging portion of the current embodiment. The engaging groove 222 has a first section 222*a* and a second section 222*b*, wherein a contour of the first section 222*a* and a contour of the second section 222*b* are respectively complementary to a contour of the narrow section 164*a* and a contour of the wide section 164*b*. That is, a width of the first section 222*a* is smaller than a width of the second section 222*b* in the third predetermined direction D3. The positioning hole 224 is adapted to position a position of the positioning member 18 in the first predetermined direction D1. In addition, as shown in FIG. 8, the box body has at least one supporting member 226. In the current embodiment, the box body 22 has a plurality of the supporting member 226 laterally abutting against the pump tube 24 in the receiving space A, along the second predetermined direction, thereby the pump tube 24 could be firmly disposed in the box body 22.

The cap body 26 of the liquid storage tank 20 enclose the opening 22*a* and is connected to a peripheral edge of the opening 22*a*. The cap body 26 fits around the pump tube 24, thereby the pump tube 24 is partially exposed outside the cap body 26. The pressing member 28 is adapted to press against a part of the pump tube 24 exposed outside the cap body 26, and has a liquid outlet 28*a* communicating with the pump tube 24 via a connecting pipe 29, wherein the connecting pipe 29 is a curved pipe with a reentrant angle of 90 degrees, and has a first port 29*a* and a second port 29*b*. The first port 29*a* is connected to the liquid outlet 28*a*, and the second port 29*b* is connected to the pump tube 24, so that the liquid outlet 28*a* communicates with the receiving space A.

The engaging groove 222 of the liquid storage tank 20 could move along the first predetermined direction D1 to be sleeved or disengaged from the engaging track 164 of the shower body 10, so that the liquid storage tank 20 could be detachably engaged with the shower body 10. It is worth mentioning that when the engaging track 164 of the shower body 10 is not completely located in the engaging groove 222 of the liquid storage tank 20, the positioning protrusion 182 is pressed by a side surface of the liquid storage tank 20, to compress the spring 184 to be completely located in the engaging hole 166*a*. Until the engaging track 164 of the shower body 10 is completely located in the engaging groove 222 of the liquid storage tank 20, and the positioning hole 224 of the liquid storage tank 20 faces the engaging hole 166*a* of the shower body 10, at this time, the spring 184 restores to its natural length by an elastic forced generated by the spring 184, wherein the elastic forced generated by the spring 184 urges the positioning protrusion 182 to moves along the second predetermined direction D2 and enter the positioning hole 224. In this way, the positioning member 18 restricts the liquid storage tank 20 from changing a position in the first predetermined direction D1, thereby preventing the liquid storage tank 20 from accidentally sliding down. As shown in FIG. 4, when the liquid storage tank 20 is pushed by an external force F toward the second predetermined direction D2, the wide section 164*b* of the engaging track 164 could be stuck in the second section 222*b* of the engaging groove 222 to prevent the liquid storage tank 20 from being detached along the second predetermined direction D2.

When a user is about to press out the cleaning solution in the receiving space A, press the pressing member 28, and the cleaning solution will flow out of the liquid outlet 28*a* by passing through the pump tube 24 and the connecting pipe 29. More specifically, in the current embodiment, the liquid outlet 28*a* faces a direction away from an outlet direction of the outlet portion. In this way, when the liquid outlet 28*a* supplies the cleaning solution, the cleaning solution would not be directly flushed away by water flowing from the outlet portion 142, and the user would not be spattered by the water from the outlet portion 142. However, in the liquid outlet 28*a* could be disposed to face other directions.

Figure 10:
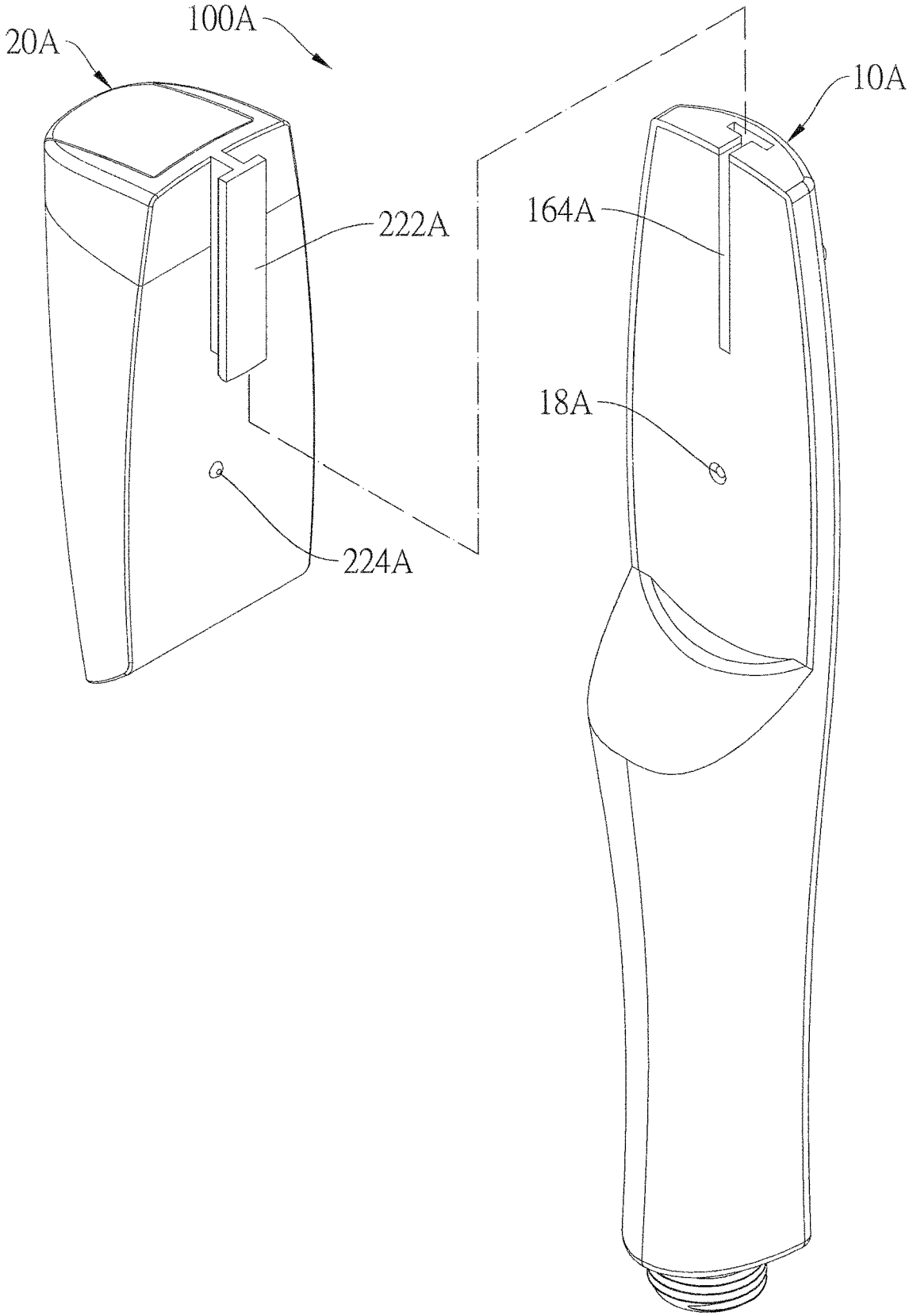
FIG. 10 is a partially exploded perspective view of the handheld shower according to a second embodiment of the present invention.

A handheld shower 100A of a second embodiment is illustrated in FIG. 10. In the current embodiment, a first engaging portion of a first liquid storage tank 20A is an engaging track 222A, and a second engaging portion of a shower body 10A is an engaging groove 164A, and the engaging track 222A could be inserted into the engaging groove 164A. In addition, a positioning member 18A is disposed on the shower body 10A, and the liquid storage tank 20A has a positioning hole 224A. The aforementioned structural design can also achieve the same restricting effect as the first embodiment.

In summary, the liquid storage tank is engaged with the shower body in a detachable manner, so that the user not only has no need to carry bottles when traveling or on business trips, but also could carry the handheld shower that the user familiar with, which could improve the user's shower experience and quality of life when going out In addition, the handheld shower of present invention could be easily assembled and detached, which is very convenient, and multiple liquid storage boxes could be carried for replacement during a long-distance trip.

It must be pointed out that the embodiments described above are only some preferred embodiments of the present invention. All equivalent structures which employ the concepts disclosed in this specification and the appended claims should fall within the scope of the present invention.

What is claimed is:

1. A handheld shower, comprising:

a shower body having an inlet channel and an outlet portion, wherein the inlet channel communicates with the outlet portion; and a liquid storage tank detachably engaged with the shower body and having a receiving space and a liquid outlet, wherein the receiving space is adapted to receive a cleaning solution; the liquid outlet communicates with the receiving space and is adapted to output the liquid solution inside the receiving space;

wherein the shower body has a first engaging portion; the liquid storage tank has a second engaging portion detachably engaged with the first engaging portion of the shower body;

wherein one of the first engaging portion and the second engaging portion has an engaging track extending along a first predetermined direction, and the other one of the first engaging portion and the second engaging portion has an engaging groove corresponding to the engaging track; the engaged track is engaged with the engaging groove; and wherein the shower body has a longitudinal direction and the engaging track; the first predetermined direction is the longitudinal direction of the shower body; the liquid storage tank has the engaging groove.

2. The handheld shower as claimed in claim 1, wherein the shower body has a receiving groove; the receiving groove and the outlet portion face opposite directions; the receiving groove is engaged with the liquid storage tank.

3. The handheld shower as claimed in claim 1, wherein the shower body has a receiving groove, and a groove surface of the receiving groove and the outlet portion face opposite directions; the engaging track has a narrow section and a wide section in a direction away from the groove surface of the receiving groove; the narrow section is connected to the groove surface; the engaging groove has a first section and a second section; a width of the first section is smaller than a width of the second section; the first section and the second section are respectively complementary to the narrow section and the wide section.

4. The handheld shower as claimed in claim 1, wherein one of the shower body and the liquid storage tank has a positioning member, and the other one of the shower body and the liquid storage tank has a positioning hole; when the liquid storage tank is engaged with the shower body, the positioning member enters the positioning hole and restricts the liquid storage tank from changing a position in the first predetermined direction.

5. The handheld shower as claimed in claim 4, wherein the positioning member is movable along a second predetermined direction to and enter the positioning hole; the second predetermined direction is orthogonal to the first predetermined direction.

6. The handheld shower as claimed in claim 5, wherein the shower body comprises a front panel and a rear panel connected to the front panel; the positioning member comprises a spring and a positioning protrusion; the front panel has the outlet portion, and a part of the inlet channel is formed between the front panel and the rear panel; the rear side panel has an engaging hole, and an axial direction of the engaging hole is parallel to the second predetermined direction; the spring and the positioning member are disposed in the engaging hole; a side of the positioning protrusion is connected to an end of the spring, and the other side of the positioning protrusion protrudes out of the engaging hole.

7. The handheld shower as claimed in claim 1, wherein the liquid storage tank has a box body, a cap body, a pump tube and a pressing member; the box body has the receiving space and an opening; the cap body is connected to a peripheral edge of the opening, and enclose the opening; the cap body fits around the pump tube; the pressing member is adapted to abut against the pump tube and has the liquid outlet; the liquid outlet communicates with the pump tube.

8. The handheld shower as claimed in claim 1, wherein the liquid outlet faces different directions from an outlet direction of the outlet portion.

9. The handheld shower as claimed in claim 8, wherein the liquid outlet faces a direction away from the outlet direction of the outlet portion.

10. A handheld shower, comprising:

a shower body having an inlet channel and an outlet portion, wherein the inlet channel communicates with the outlet portion; and a liquid storage tank detachably engaged with the shower body and having a receiving space and a liquid outlet, wherein the receiving space is adapted to receive a cleaning solution; the liquid outlet communicates with the receiving space and is adapted to output the liquid solution inside the receiving space;

wherein the shower body has a first engaging portion; the liquid storage tank has a second engaging portion detachably engaged with the first engaging portion of the shower body;

wherein one of the first engaging portion and the second engaging portion has an engaging track extending along a first predetermined direction, and the other one of the first engaging portion and the second engaging portion has an engaging groove corresponding to the engaging track; the engaged track is engaged with the engaging groove;

wherein one of the shower body and the liquid storage tank has a positioning member, and the other one of the shower body and the liquid storage tank has a positioning hole; when the liquid storage tank is engaged with the shower body, the positioning member enters the positioning hole and restricts the liquid storage tank from changing a position in the first predetermined direction; and wherein the positioning member is movable along a second predetermined direction to and enter the positioning hole; the second predetermined direction is orthogonal to the first predetermined direction.

11. The handheld shower as claimed in claim 10, wherein the shower body has a receiving groove; the receiving groove and the outlet portion face opposite directions; the receiving groove is engaged with the liquid storage tank.

12. The handheld shower as claimed in claim 10, wherein the liquid outlet faces different directions from an outlet direction of the outlet portion.

13. The handheld shower as claimed in claim 12, wherein the liquid outlet faces a direction away from the outlet direction of the outlet portion.

14. A handheld shower, comprising:

a shower body having an inlet channel and an outlet portion, wherein the inlet channel communicates with the outlet portion; and a liquid storage tank detachably engaged with the shower body and having a receiving space and a liquid outlet, wherein the receiving space is adapted to receive a cleaning solution; the liquid outlet communicates with the receiving space and is adapted to output the liquid solution inside the receiving space;

wherein the liquid storage tank has a box body, a cap body, a pump tube and a pressing member; the box body has the receiving space and an opening; the cap body is connected to a peripheral edge of the opening, and enclose the opening; the cap body fits around the pump tube; the pressing member is adapted to abut against the pump tube and has the liquid outlet; the liquid outlet communicates with the pump tube.

15. The handheld shower as claimed in claim 14, wherein the shower body has a receiving groove; the receiving groove and the outlet portion face opposite directions; the receiving groove is engaged with the liquid storage tank.

16. The handheld shower as claimed in claim 14, wherein the liquid outlet faces different directions from an outlet direction of the outlet portion.

17. The handheld shower as claimed in claim 15, wherein the liquid outlet faces a direction away from the outlet direction of the outlet portion.

* * * * *